United States Patent [19]

Backenstow et al.

[11] Patent Number: 4,649,686

[45] Date of Patent: Mar. 17, 1987

[54] HIGH WIND RESISTANT MEMBRANE ROOF SYSTEM

[75] Inventors: Don E. Backenstow; Richard J. Gillenwater, both of Carlisle, Pa.

[73] Assignee: Carlisle Corporation, Cincinnati, Ohio

[21] Appl. No.: 604,844

[22] Filed: Apr. 27, 1984

[51] Int. Cl.[4] ..... E04B 1/38

[52] U.S. Cl. ..... 52/509; 52/410

[58] Field of Search ..... 52/94, 48, 515, 309.1, 52/309.13, 408; 156/71, 91, 92, 291

[56] References Cited

U.S. PATENT DOCUMENTS

| | | | |
|---|---|---|---|
| 3,411,256 | 11/1968 | Best . | |
| 3,763,605 | 10/1973 | Freeman . | |
| 3,862,527 | 1/1975 | Peterson . | |
| 4,161,854 | 7/1979 | Stelzer | 52/309.1 |
| 4,223,486 | 9/1980 | Kelly | 52/1 |
| 4,235,058 | 11/1980 | Patry . | |
| 4,274,238 | 6/1981 | O'Riordain . | |
| 4,282,050 | 8/1981 | Thiis-Evensen . | |
| 4,343,667 | 8/1982 | Hollis | 156/157 |
| 4,351,138 | 9/1982 | McMillan et al. . | |
| 4,409,761 | 10/1983 | Bechtel | 52/1 |
| 4,419,850 | 12/1983 | Butzen | 52/94 X |
| 4,441,295 | 4/1984 | Kelly | 52/400 |
| 4,445,306 | 5/1984 | Schauffele | 52/410 |
| 4,519,175 | 5/1985 | Resan | 52/713 |
| 4,557,081 | 12/1985 | Kelly | 52/94 |

FOREIGN PATENT DOCUMENTS

| | | | |
|---|---|---|---|
| 104810 | 4/1984 | European Pat. Off. | 156/71 |

OTHER PUBLICATIONS

Kelly Energy Systems, Inc., copyright Kelly Energy Systems, Inc. 1984.

RMA Roofing Council, "Wind Design Guide for Roofing Systems", 12 page Booklet, 1985.

Firestone Rubbergard, 23 page Booklet, 1985.

Specifications for Loose Laid and Ballasted System, 1 page.

*Primary Examiner*—William F. Pate, III

*Assistant Examiner*—Creighton Smith

*Attorney, Agent, or Firm*—Wood, Herron & Evans

[57] ABSTRACT

A membrane roof system includes a single ply water impermeable membrane held to a roof deck by two separate fastening systems. The peripheral portion of the membrane is bonded to the peripheral edge of the roof deck by an adhesive and without mechanical fasteners. The central portion of the roof membrane is held down by traditional fastening means such as ballast, membrane-penetrating mechanical fastenings or preferably, non-membrane-penetrating mechanical fasteners. This provides maximum adherence around the periphery to withstand high uplift forces at a relatively low cost.

5 Claims, 5 Drawing Figures

HIGH WIND RESISTANT MEMBRANE ROOF SYSTEM

BACKGROUND OF THE INVENTION

The present invention relates to a water impermeable membrane roof system. More particularly, the present invention relates to a partially adhesively bonded membrane roof system capable of withstanding extremely high wind forces.

A membrane roof system typically refers to a roof covered with a water impermeable sheet of polymeric material such as ethylene propylene diene rubber. These roof systems are formed by covering a roof deck with a single ply of roofing membrane. The roof membrane is typically held to the roof in one of several ways. For example, the roof membrane over its entirety can be secured using adhesive. Alternately, the membrane can be secured solely with ballast. Another approach is to secure the membrane using only mechanical fasteners.

Wind uplift forces have created a problem with membrane roof systems. As wind travels across a roofing membrane, differences in air pressure caused by the moving wind tends to pull the membrane from the roof. Ballast and mechanical fasteners in general are strong enough to withstand the uplift forces of winds at normal speeds. However, they tend to fail at higher wind speeds. Adhesively secured membranes will resist wind-induced uplift forces, but are quite costly to install.

The most critical portion of the roof from the standpoint of wind-induced uplift forces is the perimeter or peripheral portion where the highest uplift forces are encountered. Roof systems have been designed to accommodate for this. For example, in a ballasted roof system, more ballast or special mechanical fasteners are used around the periphery, but this is not a cost effective method of dealing with the problem. As noted, fully adhered systems have been used where the entire membrane is bonded to the roof with adhesive. While this is the most effective method of holding a membrane to a roof and does withstand high wind-induced uplift forces at the roof perimeter, it is a very expensive roof system, and therefore undesirable for this reason.

SUMMARY OF THE INVENTION

The present invention is premised upon the realization that a cost-effective membrane roof system, capable of withstanding extremely high wind speeds, can be provided if the central portion of the membrane is secured to the roof deck solely with mechanical fasteners or ballast and the like. Peripheral portions of the membrane are adhered to the roof solely with adhesive. Using adhesive around the periphery and mechanical fasteners or ballast elsewhere effectively withstands the high uplift forces encountered at the roof perimeter, and yet represents a cost reduction over a roof membrane which is adhesively secured over its entirety or secured at its perimeter with a higher than normal density of mechanical fasteners. Additionally, it eliminates undue strain on the roof structure encountered where additional ballast is used at the perimeter to combat high wind-induced uplift forces. Accordingly, this invention provides a cost benefit and minimizes weight on the roof structure. These advantages and others will be appreciated in light of the following detailed description in which:

DETAILED DESCRIPTION

Figure 1:
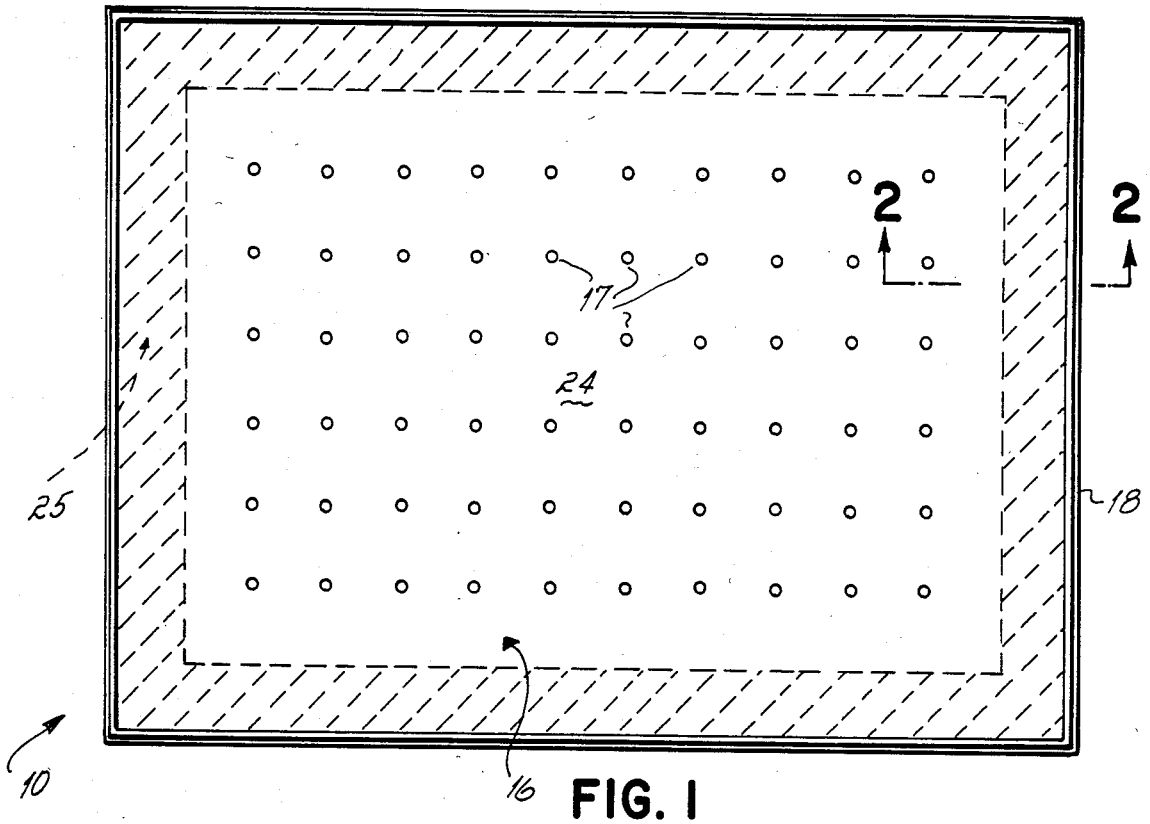
FIG. 1 is a top plan view of a roof structure illustrating one form of the present invention in which a portion of the system is cut away.

Turning now to the figures, roof structure 10 includes a structural steel deck 11 mounted upon structural supports 12 which are in turn supported by a building structure indicated generally 13. A layer of thermal insulation 14 is mounted on the structural steel deck 11 upon which is placed a roofing membrane 16. Membrane 16 is in turn fastened to the steel deck by an array of non-penetrating fasteners 17.

The particular form of roof structure thus far described is not critical to the practice of the present invention. The non-penetrating fasteners are preferred; however, ballast or penetrating mechanical fasteners such as nail strips could also be used. Various types of thermal insulation 14 could be used or, alternately, in some cases, the thermal insulation could be omitted. If thermal insulation is used, it must be mechanically fastened or adhered to the roof deck. The roof deck 11 as shown is a structural steel deck, but other materials such as concrete could be used. The total roofing system should be designed to resist a minimum uplift force of 30 pounds per square foot as measured by methods similar to the test methods specified by Factory Mutual Research in Norwood, Mass.

The illustrated roofing membrane 16 is typically formed from a series of wide sheets of waterproof material which are sealed at overlapping edges to form one continuous water impervious sheet. The material may, for example, be an ethylene propylene diene monomer rubber. A method of making EPDM membranes is disclosed in Hollis U.S. Pat. No. 4,343,667, incorporated herein by reference. The membrane 16 is additionally adhered about its perimeter by an edging or flashing 18. A horizontal flange 19 at the edging 18 is secured to the membrane 16 and the roof deck by a threaded fastener 21 spaced along the perimeter of the roof structure. The edging 18 includes a parapet 22 for precluding water flow over the edge. The fasteners 21 are typically covered with an elastomeric sealant 23 to prevent leakage to the membrane 16 at the point at which the fasteners pass through the membrane. Other types of flashing or edging not requiring penetration of the membrane are known and can be used in lieu of the edging 18.

On the roof deck, the membrane 16 includes a central portion 24 and a peripheral portion 25. The central portion of the roofing membrane is fixed to the central portion of the roof by an array of non-membrane-penetrating fasteners 17, or alternately, other traditional fastening means such as ballast or nail strips.

Figure 2:
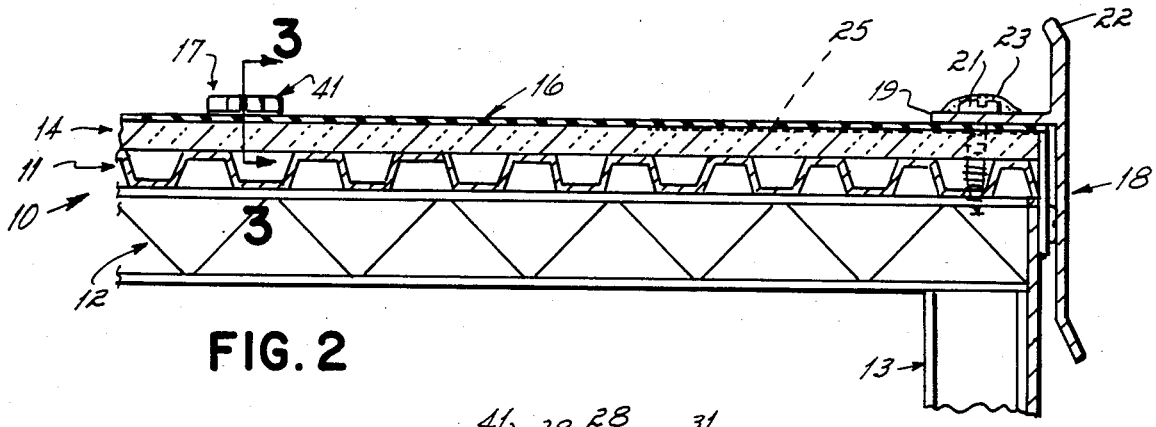
FIG. 2 is a cross sectional view of a portion of the roof structure along line 2—2 of FIG. 1.
Figure 3:
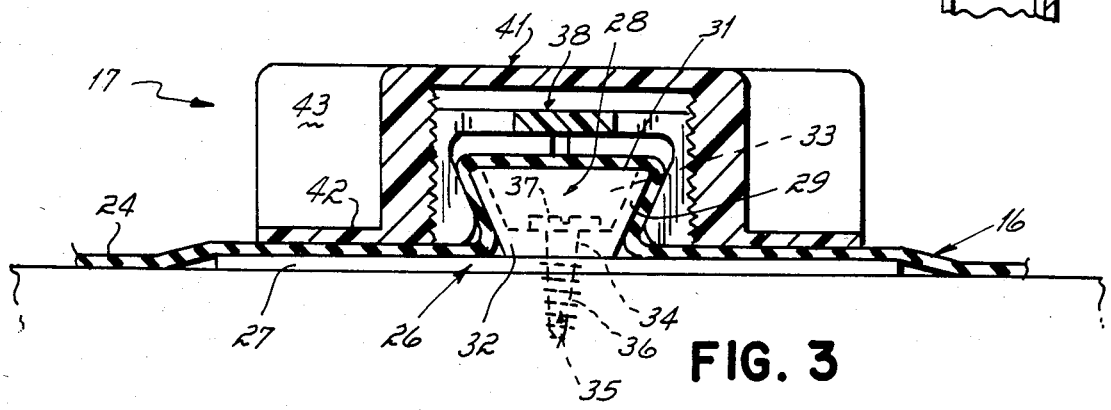
FIG. 3 is a cross sectional view taken at line 3—3 of FIG. 2.

There are many different types of non-membrane-penetrating fasteners suitable for use in the present invention. A preferred fastener is disclosed in the application of Stevan Resan entitled "Lubricated Roofing Membrane Fastener", filed June 15, 1983, Ser. No. 504,462, the disclosure of which is incorporated herein by reference. The fastener 17 comprises a three-piece non-membrane-penetrating fastener (see FIG. 2). All three pieces of the fasteners are formed of a rigid material such as polyvinyl chloride. The first piece of the fastener 17 is a base or anchor disk 26. The anchor disk 26 comprises a generally flat circular disk 27 having a hollow inverted frusto-conical projection or button 28 extending upwardly from the central portion of the disk 27. The wall 29 of the button 28 extends radially outward from the disk 27 so that a top or rim 31 of the button 28 is wider than the base 32 of button 28. The button 28 further includes a hollow interior 33 adapted to receive the head of a bolt, a screw or nail. A hole 34 extends from within the interior 33 directly through the center of disk 27. The hole is adapted to permit the shank of a bolt, screw or nail to pass through and to prevent the head of the bolt, screw or nail from passing through.

The anchor disk 26 is fastened to the deck 11 by screw 35 having a shank portion 36 extending through hole 34 through the center of anchor 26 into the deck 11. A plurality or array of these anchor disks are secured to the central portion 24 of the roof surface normally spaced two to four feet on center.

The disks and the roof deck are covered with the EPDM rubber sheeting material generally having a thickness of from 0.040–0.065 inches in thickness. The membrane is held to the anchor disks by the second piece of the fastener 38 a circular tined retainer cap 38. The retainer cap 38 is adapted to fit over and clamp onto the button 28 of disk 26 with the membrane held between the retainer cap and button. The retainer cap includes the plurality of flexible tines adapted to extend over the membrane and over the button and flex backwardly onto the button holding the membrane in place. The retainer is externally threaded and is held in position by an internally threaded cover 41. Internally threaded cover 41 is screwed onto the retainer. This holds the tines of the retainer in position, preventing the retainer from popping off the button and releasing the roofing membrane. The outer cover includes a peripheral flange 42 which when screwed down upon the tine cap flattens the roofing membrane against the disk portion of the anchor disk. This cover may include two radially extended fins 43 which enable the cover to be grasped and rotated with the hand.

The non-penetrating fasteners are used only to adhere the central portion 24 of the membrane to the central portion of the roof deck. One fastener is used per two (2) to fifty (50) square feet of central portion of said membrane. The peripheral portion 25 (depicted by shading) of the membrane is bonded to the peripheral edge of the roof deck by means of a permanent adhesive. Any adhesive capable of holding the membrane to the roof deck, when an uplift force of approximately one pound per square inch or greater is encountered, is suitable. Neoprene adhesives are generally suitable for bonding EPDM sheeting to a roof deck, for example, Uniroyal M6317. Block polymer based adhesives, such as Kraton-based adhesives, are also suitable. If the EPDM has a high temperature protective coating, hot coal tar may be used. Butyl adhesives such as Uniroyal M6365 are also suitable.

The width of the peripheral edge of the roof membrane which is adhesively bonded to the peripheral edge of the roof deck will be at least about three feet wide or more depending on the geographic location and the height of the building. For most buildings, the width of the adhesively bonded perimeter should be equal to about one quarter to one third the height of the building to a maximum width, normally not to exceed forty feet independent of the building height. The adhesive is applied to the peripheral portion of the roof deck by rolling, brushing or spraying. If the membrane is a dusted sheet, such as dust covered EPDM, adhesive should also be applied to the peripheral portion of the membrane to insure adequate adhesion.

Figure 4:
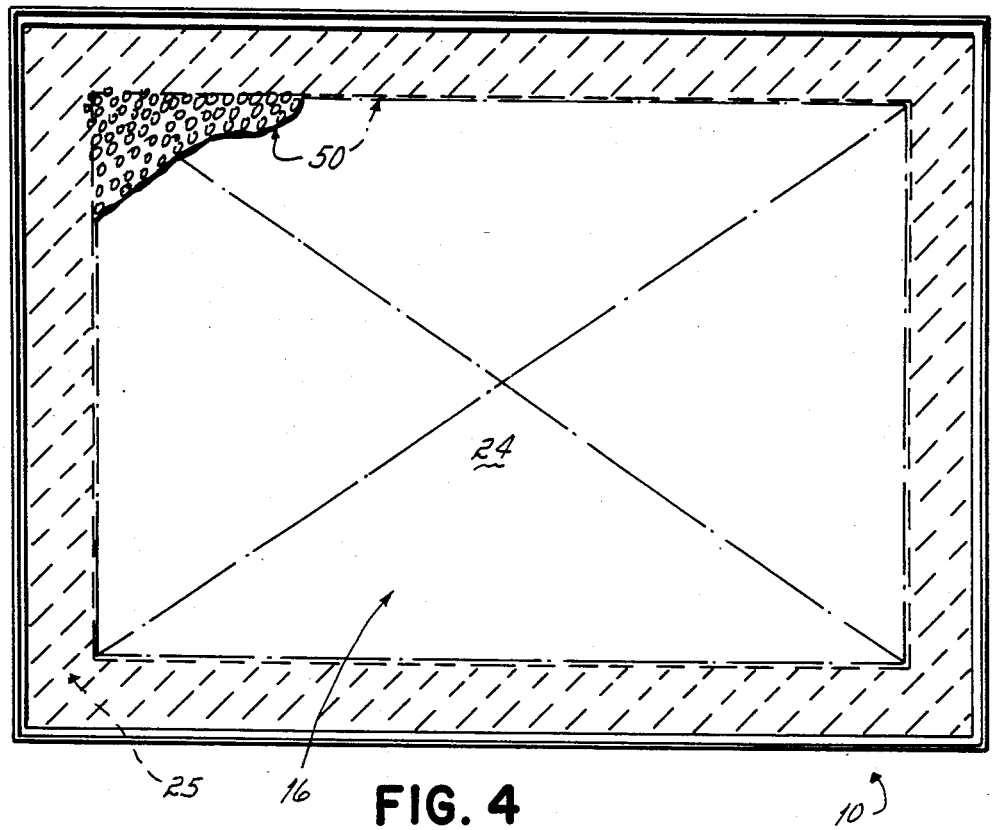
FIG. 4 is a top plan view of an alternate embodiment of the present invention.
Figure 5:
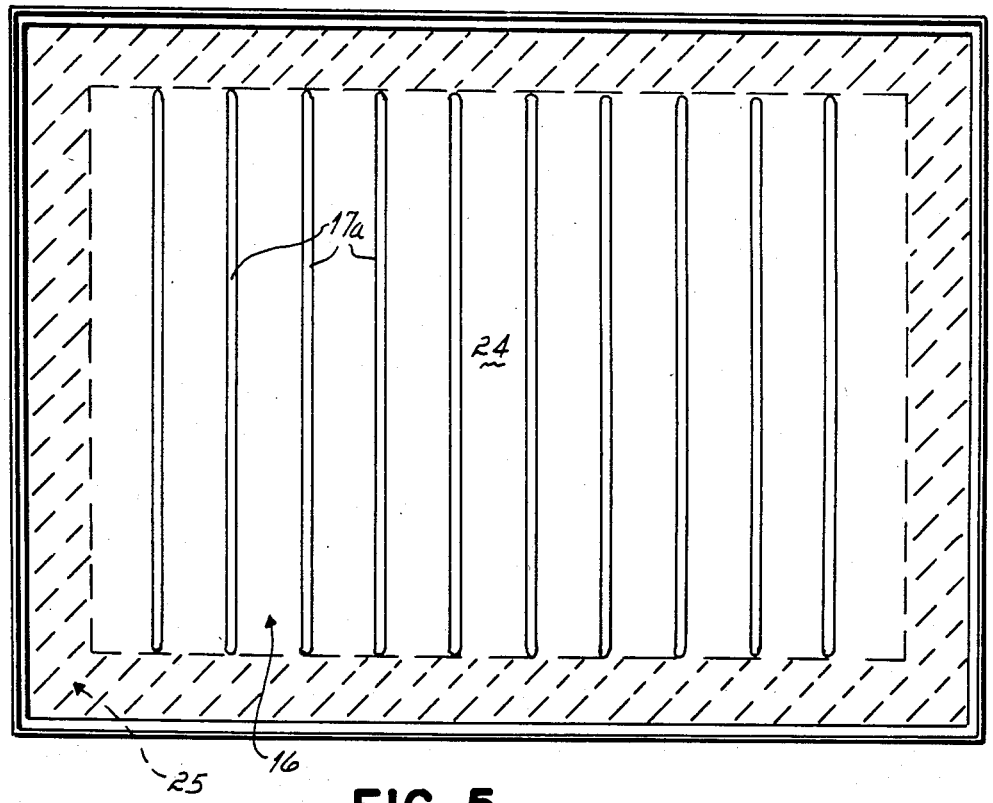
FIG. 5 is a top plan view of a second alternate embodiment of the present invention.

FIGS. 4 and 5 each depict alternate embodiments of the present invention. FIG. 4 depicts a ballasted roof according to the present invention wherein the peripheral edge 25 of the roofing membrane 16 is bonded to the roof deck with an adhesive. The central portion 24 of the membrane is held in position by ballast 50, specifically gravel. This is diagrammatically depicted by the dotted portion of the FIG. 4. Ballast and/or mechanical fasteners can be used in addition to the adhesive at the peripheral edge if added strength is required. The net resistance of the roofing system to wind uplift should be improved by using any combination of ballast and/or mechanical fasteners in addition to the adhesive bonded section.

FIG. 5 depicts a mechanically fastened system in which the central portion 24 of the membrane is held in position by a plurality of nail strips 17*a*, and the peripheral edge 25 is bonded to the roof deck with an adhesive. There are different types of nail strips used in roof fastening systems and many different types of penetrating fasteners. Generally, any such membrane-penetrating or non-membrane-penetrating fastener would be suitable for use in this invention, although a preferred form is disclosed in Schauffele U.S. patent application Ser. No. 385,058, filed June 4, 1982, incorporated herein by reference.

Thus, having described my invention and its advantages, we claim:

1. A water proof roofing system for a roof deck on a building comprising:

a water impermeable membrane located on top of said roof deck, said membrane including a peripheral portion and a central portion;

non-adhesive fastening means for non-adhesively securing, said central portion of said membrane to an underlying central portion of said roof deck, said non-adhesive fastening means selected from the group consisting of ballast, non-membrane penetrating mechanical fasteners and membrane penetrating mechanical fasteners; and permanent adhesive disposed between and in contact with said peripheral portion of said membrane and the underlying peripheral portion of said roof deck for permanently bonding said peripheral portion of said membrane to the underlying peripheral portion of said roof deck to effectively resist high wind induced uplift forces on said membrane periphery, wherein said peripheral portion is at least three feet wide.

2. The system claimed in claim 1 wherein said non-adhesive fastening means comprises an array of non-membrane-penetrating mechanical fasteners.

3. The roof system claimed in claim 2 wherein said non-membrane-penetrating mechanical fasteners each comprise an anchoring disk, said disk including a central hollow inverted frusto-conical button;

an externally threaded tined retainer cap adapted to snap onto said button of said anchor with said membrane held between said retainer and said button to clamp said membrane to said button; and an internally threaded cover adapted to screw onto said externally threaded tined retainer cap to hold said tined retainer cap and button engaged with said membrane gripped therebetween.

4. The roof system claimed in claim 1 wherein said peripheral portion of said membrane is at least as wide as one-quarter the height of said building to a maximum of forty feet wide.

5. The system claimed in claim 3 comprising one fastener per two to fifty square feet of central portion of said membrane.

* * * * *